US009829287B2

(12) United States Patent
Lee

(10) Patent No.: US 9,829,287 B2
(45) Date of Patent: Nov. 28, 2017

(54) EXPLOSIVE TUBE HAVING AIR GAP AND METHOD OF BLASTING BEDROCK USING SAME

(71) Applicant: Jin Sung Lee, Gyeonggi-do (KR)

(72) Inventor: Jin Sung Lee, Gyeonggi-do (KR)

( * ) Notice: Subject to any disclaimer, the term of this patent is extended or adjusted under 35 U.S.C. 154(b) by 0 days.

(21) Appl. No.: 15/104,367

(22) PCT Filed: Dec. 9, 2014

(86) PCT No.: PCT/KR2014/012052

§ 371 (c)(1),
(2) Date: Jun. 14, 2016

(87) PCT Pub. No.: WO2015/099319

PCT Pub. Date: Jul. 2, 2015

(65) Prior Publication Data

US 2016/0377392 A1 Dec. 29, 2016

(30) Foreign Application Priority Data

Dec. 24, 2013 (KR) ..... 10-2013-0162208

(51) Int. Cl.

| | |
|---|---|
| ***F41G 1/00*** | (2006.01) |
| ***F42B 3/02*** | (2006.01) |
| ***F42D 1/20*** | (2006.01) |
| ***F42D 3/04*** | (2006.01) |

(52) U.S. Cl.
CPC ..... *F42B 3/02* (2013.01); *F42D 1/20* (2013.01); *F42D 3/04* (2013.01)

(58) Field of Classification Search
CPC ..... F42D 3/04; F42D 1/00; F42D 1/04; F42D 1/22; E21B 43/148; F42B 3/02
USPC ..... 102/312, 313, 315; 175/4.55–4.59
See application file for complete search history.

(56) References Cited

U.S. PATENT DOCUMENTS 1,851,122 A * 3/1932 Tese ..... F42B 3/00 102/202.14
3,580,171 A * 5/1971 Maes ..... C06B 47/08 102/202.11
3,832,950 A * 9/1974 Hurst ..... F42B 3/00 102/315

(Continued)

FOREIGN PATENT DOCUMENTS

KR 20010069741 4/2001
KR 20040001724 1/2004

(Continued)

*Primary Examiner* — Samir Abdosh
(74) *Attorney, Agent, or Firm* — IPLA P.A.; James E. Bame

(57) ABSTRACT

An explosive tube having an air gap and a method of blasting bedrock using the same, comprising: a filling tube having a filling space which is to be filled with explosives; and an air tube, the upper part of which is connected with another tube to form an air gap space therein, and which has an insertion hole formed on the bottom of the air tube to introduce the explosives into the filling space, the air tube being integrally formed on the filling tube. A plurality of tubes filled with explosives are connected with each other and inserted into blasting holes formed through bedrock to break the bedrock by blasting the explosives. By forming an air gap in the upper part of the tube.

7 Claims, 14 Drawing Sheets

(56) References Cited

U.S. PATENT DOCUMENTS

| | | | | | |
|---|---|---|---|---|---|
| 3,926,119 | A * | 12/1975 | Hurst | C06B 47/00 | 102/315 |
| 4,006,687 | A * | 2/1977 | Ridgeway | C06B 47/00 | 102/202.11 |
| 6,901,865 | B1 * | 6/2005 | Thomson | F42D 1/22 | 102/313 |
| 9,181,790 | B2 * | 11/2015 | Mace | F23Q 21/00 | |
| 9,354,029 | B2 * | 5/2016 | Mace | F23Q 21/00 | |
| 9,476,685 | B2 * | 10/2016 | Mace | F23Q 21/00 | |
| 9,488,456 | B2 * | 11/2016 | Mace | F23Q 21/00 | |
| 9,593,924 | B2 * | 3/2017 | Mace | F23Q 21/00 | |

FOREIGN PATENT DOCUMENTS

| | | |
|---|---|---|
| KR | 100882851 | 2/2009 |
| KR | 101022251 | 3/2011 |

* cited by examiner

EXPLOSIVE TUBE HAVING AIR GAP AND METHOD OF BLASTING BEDROCK USING SAME

BACKGROUND

The present invention relates to a tube which is charged with explosives and a method of blasting bedrock using the same, and more particularly, to an explosive tube, which is charged with explosives and is inserted into a hole bored in a bedrock, and a method of blasting a bedrock using the same.

In general, blasting construction means construction for blasting bedrocks, such as cutting work of raw stones in a mine or a quarry, tunneling work in a rock field, cutting work of a concrete structure and road opening work, and recently, blasting construction, such as underground excavation work, power cable work and pipe construction for a building, and subway construction, has been frequently carried out in downtown areas.

The blasting construction includes not only work to crunch big stones into little pieces but also a larger work to explode several tons of stones at the same time, and has been carried out through designs using construction methods defined by each pattern.

Conventional bedrock blasting methods which have been widely used are divided into a general blasting method of drilling a blast hole in a bedrock, charging the inside of the blast hole with explosives and tamping materials and carrying out explosion, a blasting method by deck charge of arranging explosives and tamping materials by turns inside a hole and carrying out explosion in order to reduce vibration, and a pre-split blasting method carried out to arrange the slope.

Moreover, for blasting, ammonium nitrate fuel oil (ANFO) explosives, bulk explosives, water gel explosives and so on have been used. The ANFO explosives have been the most generally used due to economic feasibility because being ammonium explosives in which ammonium nitrate is mixed with fuel oil, but need primers or boosters, are difficult to be stored for a long time because of absorptiveness and weak in water resistance.

FIG. 1*a* is a sectional view of a general blasting method by conventional explosives. In FIG. 1*a*, initial explosives 2, detonators 3 and explosives 4, such as ANFO explosives or bulk explosives, are loaded inside a charge hole 1 of a bedrock, the remaining space is tamped with tamping materials 5, and then, explosion is carried out. However, such a general blasting method has several disadvantages in that it generates big vibration and explosive sound and there is a risk of shattering because the initial explosives 2 loaded inside the charge hole 1 are blasted in concentration on the lower part of the charge hole 1, in that there is high probability of generating boulder stones, which are bulk rocks, because the tamping materials 5 are relatively longer than the depth of the bored hole and explosive power cannot reach the bedrock around the tamping materials, in that it is uneconomical because excessive explosives are used due to over-charging, in that a detonator lead gets longer due to indirect priming, and in that ANFO explosives may cause static electricity.

In order to overcome the above disadvantages, FIG. 1*b* is a sectional view showing the blasting method by deck charge by conventional explosives. As shown in FIG. 1*b*, according to the blasting method by deck charge, the step of loading initial explosives 2, detonators 3 and explosives 4, such as ANFO explosives or bulk explosives, inside a charge hole 1 and the step of tamping the tamping materials 5 are carried out by turns to form a stratiform charge, and in this instance, the detonators 3 are individually loaded as many as the number of the stratiform charges so that the explosives are individually exploded inside the same hole at specified time intervals to crush rocks. However, the blasting method by deck charge has several disadvantages in that it is expensive and complicated because it requires the detonators as many as the number of the stratiform charges, in that it is inefficient and uneconomical because it is difficult to load the explosives 4 and the tamping materials 5 by turns, and in that damping effect of vibration or explosive sound is not good because explosives of the same amount must be used.

Moreover, Korean Patent No. 10-0882851 published on Feb. 10, 2009 discloses a method for blasting rocks using an air deck filled with rocks, which forms an air deck space between an explosive and an explosive or between an explosive and a tamping material inside a charge hole. However, the blasting method is a method of directly charging explosives and tamping materials inside the charge hole, in case of ANFO explosives which have weak water resistance, the method cannot be easily applied to geographical features of Korea which have lots of underground water and cavities, and it is difficult to realize quantification of explosives.

Furthermore, in general, in order to crush rocks, explosives are excessively concentrated on the lower part. Additionally, the existing cushion blasting method is a method of blasting by binding explosives to detonating fuses at regular intervals, but is not used widely because it is complicated and uneconomical due to a high price of the detonating fuses.

SUMMARY OF THE INVENTION

Accordingly, the present invention has been made in an effort to solve the above-mentioned problems occurring in the prior arts, and it is an object of the present invention to provide an explosive tube having an air gap and a method of blasting a bedrock using the same, which can quantify explosives and reduce an explosive usage by forming an air gap onto an upper part of a tube so as to increase blasting efficiency and significantly reduce expenses, increase the length of a cartridge of the explosives in comparison with the same amount of the explosives and enlarge a projection area at the time of explosion so as to increase blasting effect, and reduce blasting pollution, such as blast pressure, scattered stones, vibration and noise, generated during explosion by applying a cushion blasting method.

It is another object of the present invention to provide an explosive tube having an air gap and a method of blasting a bedrock using the same, which can set a charge amount and a charging location of explosives in various ways so as to precisely control explosion according to characteristics of rocks by controlling power of explosion, prevent back break that rocks are destroyed beyond a design, and effectively crush rocks with a small amount of explosives by positively utilizing a free face.

It is a further object of the present invention to provide an explosive tube having an air gap and a method of blasting a bedrock using the same, which are easy, safe and convenient to insert and pull explosives into and out of the bored hole because the detonator is inserted into the tube not to be separated and quantified explosives are produced previously, and which can increase waterproofing property by blocking an insertion hole with a lid.

To achieve the above objects, the present invention provides an explosive tube which is used to crush a bedrock by blasting explosives after a plurality of the tubes charged with the explosives are connected with one another and are inserted into a blast hole bored in a bedrock, the explosive tube including: a charge tube having a charging space charged with explosives; and an air tube which is formed integrally above the charge tube, has a space of an air gap formed therein when another tube is connected to the upper part of the former tube, and has an insertion hole formed in the bottom to charge the charging space with the explosives.

In this instance, preferably, the tube has an induction groove formed in a longitudinal direction of the tube to induce a blasting direction to the outer circumference. Moreover, preferably, the charge tube has a weight inserted and mounted to the lower part thereof and a scale indicated on the outer circumferential surface thereof.

Furthermore, preferably, the charge tube is rounded at a lower end portion thereof.

Additionally, preferably, the inner circumferential surface of the air tube is tapered downward.

In addition, preferably, the air tube further has a lid for blocking the insertion hole after the charge tube is charged with the explosives.

Moreover, preferably, the explosive tube further includes a connection tube for connecting the tubes with each other.

Furthermore, the charge tube is charged with mixture of an ammonium nitrate fuel oil (ANFO) explosive and an emulsion-based explosive.

In another aspect of the present invention, the present invention provides a method of crushing a bedrock by blasting explosives after connecting a plurality of tubes, each of which includes a charge tube having a charging space charged with explosives and an air tube formed integrally above the charge tube and having an insertion hole formed in the bottom to put in the explosives, with one another and inserting the tubes into a blast hole bored in a bedrock, the method including: a blast hole boring step for boring a plurality of blast holes in the bedrock in predetermined arrangement and depth; an explosive charging step for charging the charging spaces of the plural tubes with explosives through the insertion holes; a tube connecting step for connecting a plurality of the tubes charged with the explosives with one another, wherein another tube is connected to the upper part of the tube so as to form a space of an air gap inside the air tube; a tube inserting step for inserting the tubes into the blast hole; a primer inserting step for inserting a primer to which a detonator is connected into the charge tube of the tube inserted into the blast hole or into the upper part of the tube which is inserted into the uppermost part of the blast hole; a tamping material charging step for charging the remaining space of the blast hole with tamping materials; and a detonating step for detonating the detonator by a blasting machine from the outside in order to crush the bedrock.

In a further aspect of the present invention, the present invention provides a method of crushing a bedrock by blasting explosives after connecting a plurality of tubes, each of which includes a charge tube having a charging space charged with explosives and an air tube formed integrally above the charge tube and having an insertion hole formed in the bottom to put in the explosives, with one another and inserting the tubes into a blast hole bored in a bedrock, the method including: a blast hole boring step for boring a plurality of blast holes in the bedrock in predetermined arrangement and depth; an explosive charging step for charging the charging spaces of the plural tubes with explosives through the insertion holes; a tube connecting step for connecting a plurality of the tubes charged with the explosives with one another, wherein another tube is connected to the upper part of the tube so as to form a space of an air gap inside the air tube; a tube inserting step for inserting the tubes into the blast hole; a detonator installing step for inserting and installing a detonator into the charge tube of the tube inserted into the blast hole; a tamping material charging step for charging the remaining space of the blast hole with tamping materials; and a detonating step for detonating the detonator by a blasting machine from the outside in order to crush the bedrock.

Here, preferably, the method of blasting the bedrock further includes an insertion hole blocking step for blocking the insertion hole with a lid after the explosive charging step.

Additionally, preferably, a connection tube is interposed between the two tubes in the tube connecting step.

In addition, the charge tube is charged with mixture of an ammonium nitrate fuel oil (ANFO) explosive and an emulsion-based explosive.

As described above, the explosive tube and the method of blasting a bedrock using the same according to the present invention can quantify explosives and reduce an explosive usage by forming an air gap onto an upper part of a tube so as to increase blasting efficiency and significantly reduce expenses, increase the length of a cartridge of the explosives in comparison with the same amount of the explosives, and enlarge a projection area at the time of explosion so as to increase blasting effect, and reduce blasting pollution, such as blast pressure, scattered stones, vibration and noise, generated during explosion by applying a cushion blasting method.

Moreover, the explosive tube and the method of blasting a bedrock using the same according to the present invention can set a charge amount and a charging location of explosives in various ways so as to precisely control explosion, for instance, by controlling power of explosion, prevent back break that rocks are destroyed beyond a design, and carry out concentrated crushing toward a crushing direction of rocks.

Furthermore, the explosive tube and the method of blasting a bedrock using the same according to the present invention can be easily applied to varied geographies with lots of underground water or cavities through an increase of waterproofing property by blocking the insertion hole with the lid.

Additionally, when blasting is carried out using direct priming after the detonator is located at the inlet of the blast hole, because shock waves reach the free face rapidly, the explosive tube and the method of blasting a bedrock using the same according to the present invention can increase blasting power and make insertion of the detonators and arrangement of the detonator leads easy and convenient.

Figure 1A:
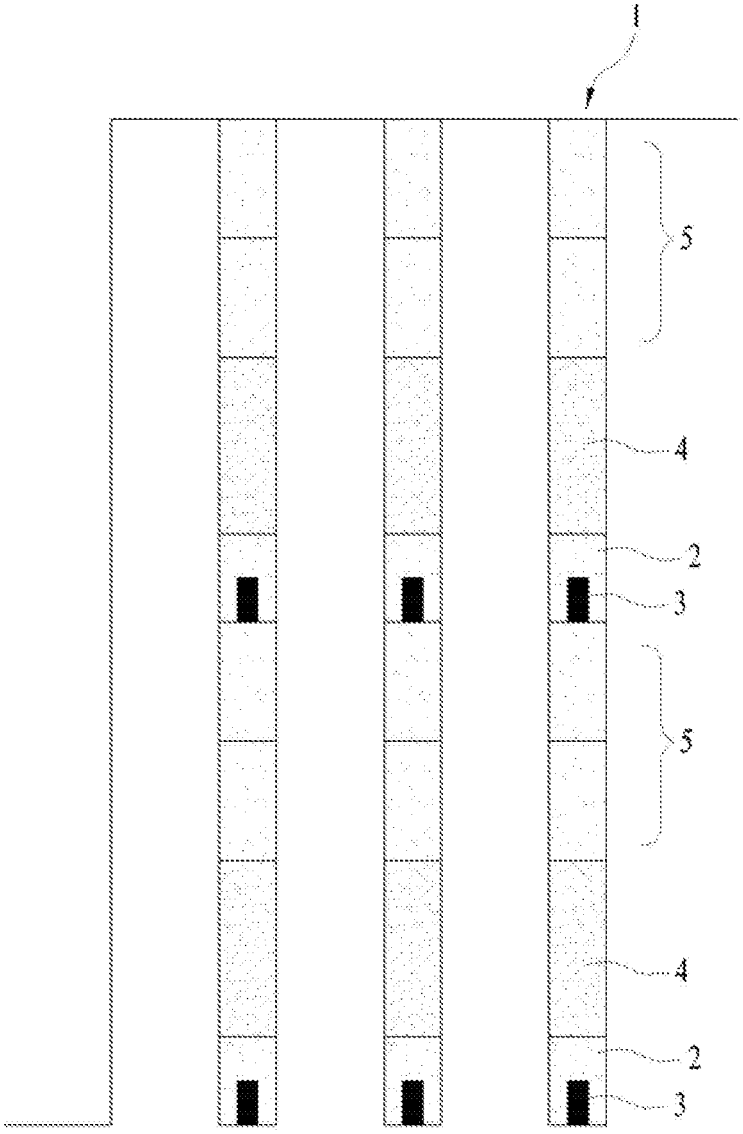
FIG. 1*a* is a sectional view showing a general blasting method by conventional explosives.
Figure 1B:
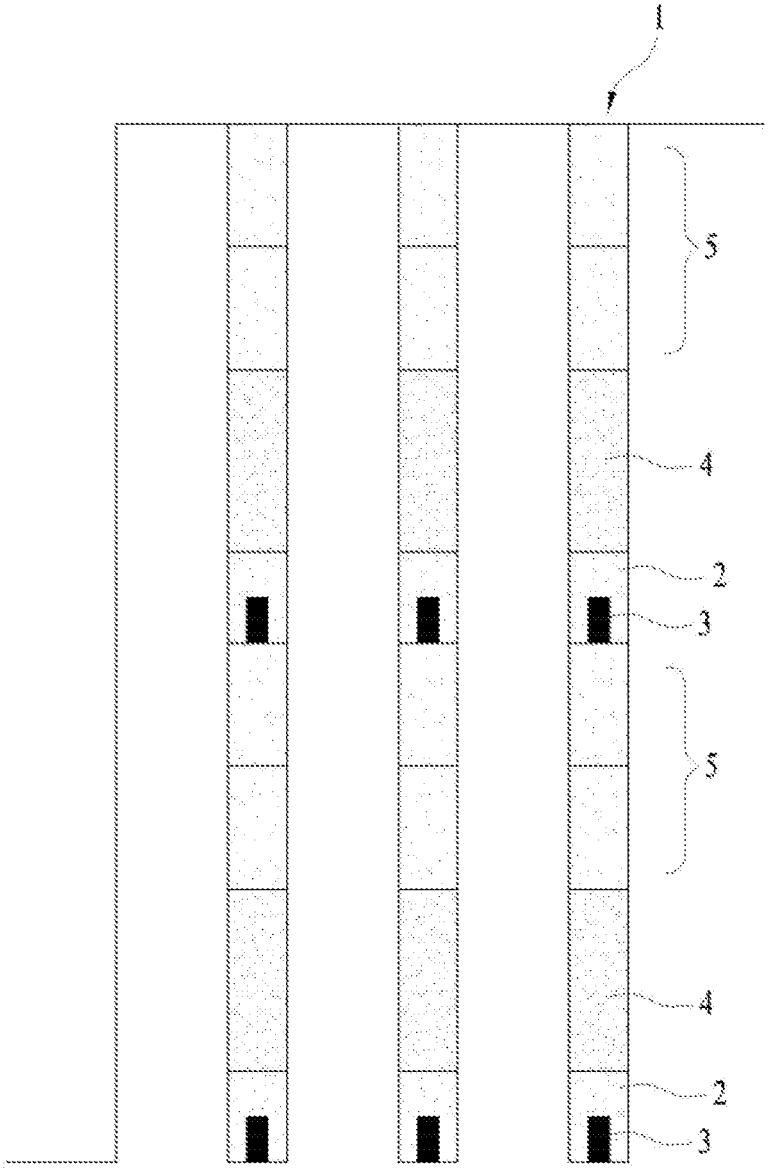
FIG. 1*b* is a sectional view showing a blasting method by deck charge by conventional explosives.

Explanation of numerals of essential parts in drawings

1: charge hole, 2: initial explosive,
3: detonator, 4: explosive
5: tamping material, 10: charge tube
11: charging space, 12: weight
13: scale, 14: round part
20: air tube, 21: air gap
22: insertion hole, 23: lid
30: connection tube, 31: upper connection part
32: lower connection part, A: tamping material
D: detonator, E: explosive
G: induction groove, H: blast hole
L: detonator lead, P: primer
R: rock, T: tube To achieve the above objects, the present invention provides an explosive tube which is used to crush a bedrock by blasting explosives after a plurality of the tubes charged with the explosives are connected with one another and are inserted into a blast hole bored in a bedrock, the explosive tube including: a charge tube having a charging space charged with explosives; and an air tube which is formed integrally above the charge tube, has a space of an air gap formed therein when another tube is connected to the upper part of the former tube, and has an insertion hole formed in the bottom to charge the charging space with the explosives.

Furthermore, the present invention provides a method of crushing a bedrock by blasting explosives after connecting a plurality of tubes, each of which includes a charge tube having a charging space charged with explosives and an air tube formed integrally above the charge tube and having an insertion hole formed in the bottom to put in the explosives, with one another and inserting the tubes into a blast hole bored in a bedrock, the method including: a blast hole boring step for boring a plurality of blast holes in the bedrock in predetermined arrangement and depth; an explosive charging step for charging the charging spaces of the plural tubes with explosives through the insertion holes; a tube connecting step for connecting a plurality of the tubes charged with the explosives with one another, wherein another tube is connected to the upper part of the tube so as to form a space of an air gap inside the air tube; a tube inserting step for inserting the tubes into the blast hole; a primer inserting step for inserting a primer to which a detonator is connected into the charge tube of the tube inserted into the blast hole or into the upper part of the tube which is inserted into the uppermost part of the blast hole; a tamping material charging step for charging the remaining space of the blast hole with tamping materials; and a detonating step for detonating the detonator by a blasting machine from the outside in order to crush the bedrock.

DETAILED DESCRIPTION OF THE INVENTION

Hereinafter, reference will be now made in detail to the preferred embodiment of the present invention with reference to the attached drawings.

Figure 2:
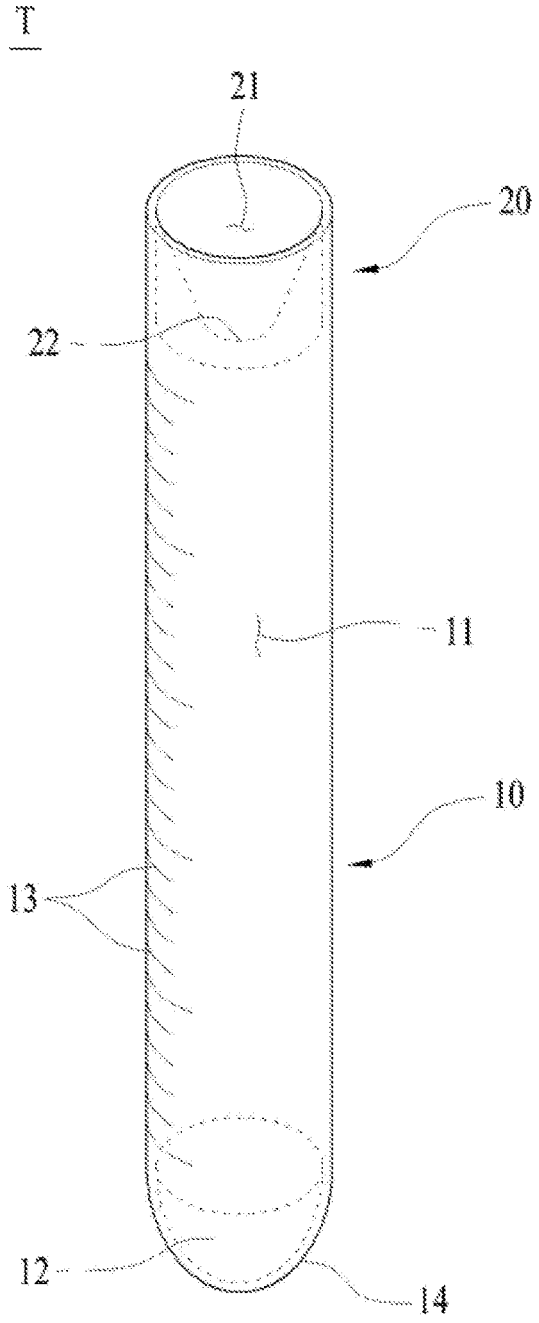
FIG. 2 is a perspective view showing a structure of a tube according to the present invention.
Figure 3:
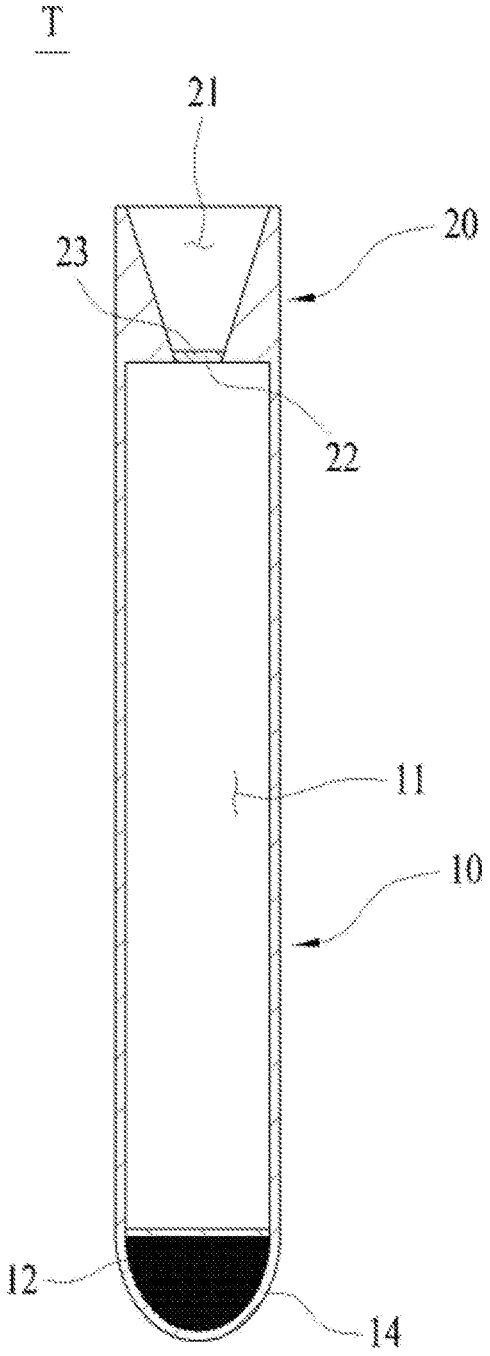
FIG. 3 is a sectional view showing the structure of the tube according to the present invention.

Referring to FIGS. 2 and 3, according to the present invention, a plurality of explosive tubes (T) which are charged with explosives (E) are connected with each other and are inserted into a blast hole (H) bored in a rock (R), and then, the explosives (E) are blasted to crush the rock (R). Each of the tubes (T) is formed by a charge tube 10 and an air tube 20 integrally connected with each other.

In this instance, the tube (T) is formed to be opened at the upper part and is elongated in a longitudinal direction, can prevent that explosives which have weak water resistance melt by water, such as underground water, inside a blast hole 2. The tube (T) is made of transparent synthetic resin, such as PP or PE, but is not limited to the above.

Figure 4:
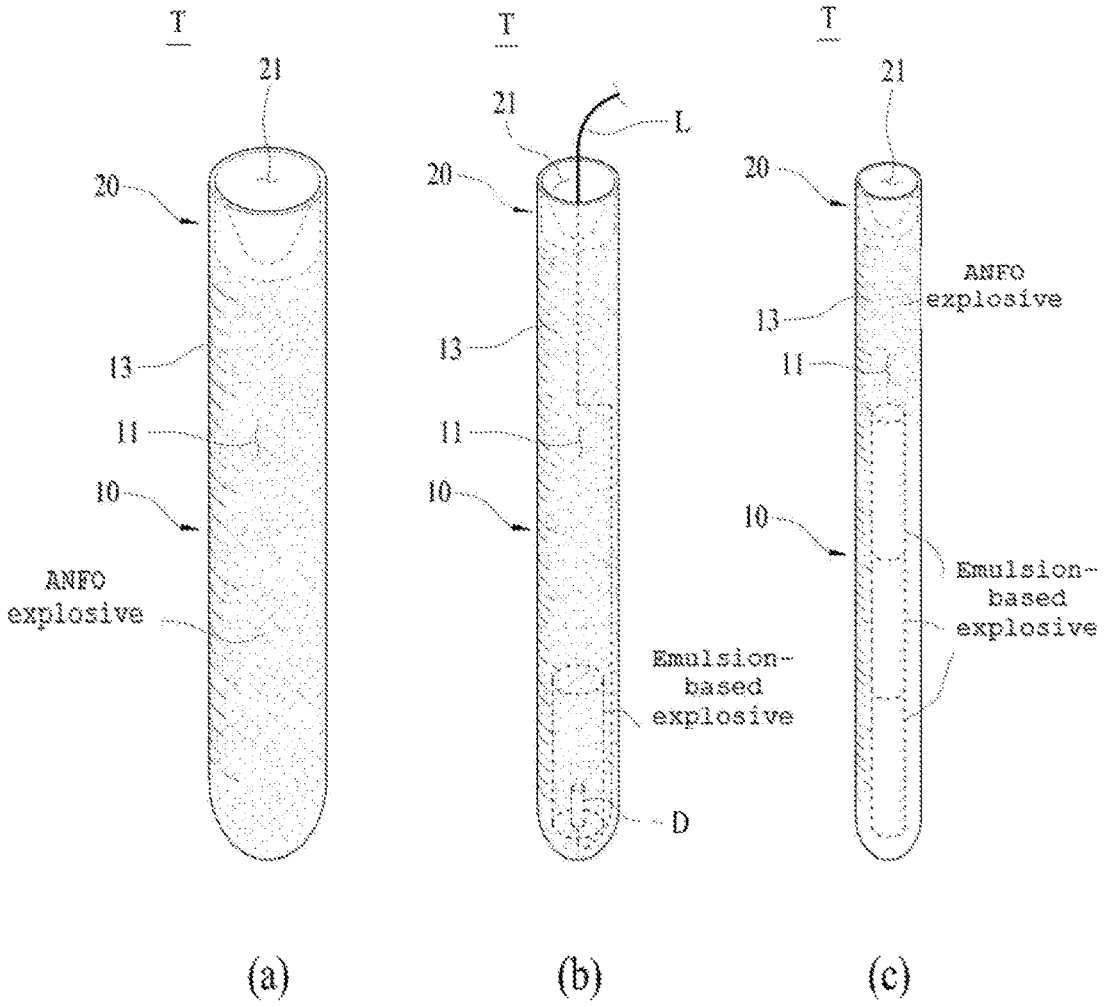
FIG. 4 is a view illustrating kinds of the tube according to the present invention, wherein FIG. 4(*a*) shows the tube which is 50 mm in diameter, FIG. 4(*b*) shows the tube which is 34 mm in diameter and FIG. 4(*c*) shows the tube which is 25 mm in diameter.

Moreover, the tube (T) may be cut and manufactured to fit to the diameter and depth of the blast hole (H), but, as shown in FIG. 4, may be standardized and selectively used into various sizes according to diameters of the blast hole (H). Here, the diameter of the tube (T) is smaller than that of the blast hole (H).

The tube (T) may be charged with various kinds of explosives in different arrangements. For instance, FIG. 4(*a*) illustrates a case that the tube (T) is charged only with ammonium nitrate fuel oil (ANFO) explosives, and it is low in bulk density and detonation velocity because being generally 3,200 m/sec in detonation velocity and 540 l/kg in gas emission, has static effect using gas pressure and is advantageous when blasting soft rocks or normal rocks.

Furthermore, FIG. 4(*b*) illustrates a case that emulsion-based explosives to which a detonator is connected is arranged below the tube (T) and the remaining space of the tube (T) is charged with ANFO explosives, and it increases detonation velocity and explosive power by getting faster reaction speed of the explosives than using only the ANFO explosives, gets more gas pressure and less explosive power than using only the emulsion-based explosives, and may be applied to blast normal rocks or hard rocks.

Additionally, FIG. 4(*c*) illustrates a case that the tube (T) is charged only with emulsion-based explosives or charged with emulsion-based explosives and a small amount of ANFO explosives, and it greatly increases detonation velocity and explosive power, shows dynamic effect, and is advantageous in blasting hard rocks.

Figure 7:
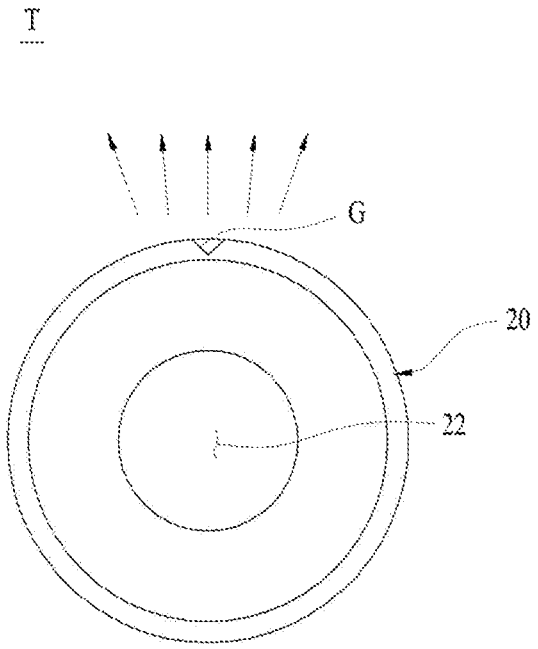
FIG. 7 is a sectional view showing connection of tubes in a state where a connection tube is interposed between the tubes.

As shown in FIG. 7, the tube (T) has an induction groove (G) formed in the longitudinal direction so as to induce a blasting direction toward the induction groove (G) at the time of blasting, prevent back break that destroys rocks beyond a design, and intensively crush the rocks in a crushing direction.

The charge tube 10 includes a charging space 11 which is charged with explosives (E), and the explosives (E) may be ANFO explosives, bulk explosives, water gel explosives and so on, but are not limited to the above.

In this instance, it is preferable that a weight be inserted and mounted into a lower part of the charge tube 10. The weight 12 facilitates that the tube (T) is inserted into the bottom surface of the blast hole (H), and especially, even though water, such as underground water, exist inside the blast hole (H), the tube (T) containing the ANFO explosives, which is smaller in specific gravity than water, can be easily inserted. The weight 12 may be made of metal or rock.

In addition, it is preferable that the charge tube 10 have a scale 13 indicated on the outer circumferential surface thereof, and the scale 13 is to check an amount of the explosives (E) filling the charging space 11 so as to quantify the explosives and reduce usage of the explosives.

Moreover, the charge tube 10 includes a round part 14 that a lower end is rounded, and the round part 14 prevents that the lower end of the charge tube 10 is damaged by being caught to an inwardly protruding part of the blast hole (H) when the tube (T) is inserted into the blast hole (H) bored in the rock (R).

It is preferable that the air tube 20 be formed integrally to the upper part of the charge tube 10, and has an inlet opened and an outlet which is formed at the bottom and has an insertion hole 22 to put the explosives into the charging space 11. Furthermore, after the charging space 11 is charged with the explosives (E), a lid 23 blocks the insertion hole 22 in order to increase waterproofing property.

In this instance, the air tube 20 has an inner surface formed to get upwardly wider, is tapered downward and has a reversed trapezoidal cross section, so that the explosives can be easily put into the charging space 11 communicated with the insertion hole 22.

Figure 5:
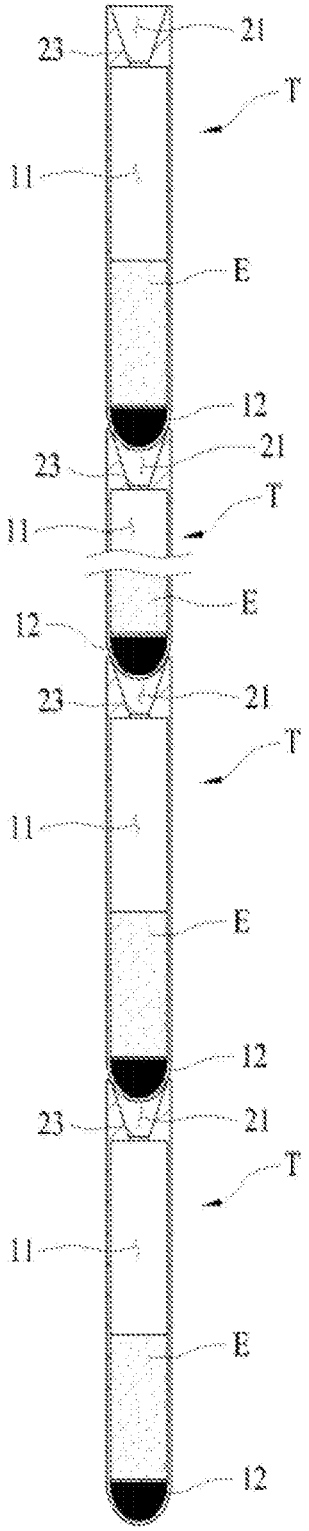
FIG. 5 is a sectional view showing connection of a plurality of tubes according to the present invention.

Furthermore, as shown in FIG. 5, another tube (T) is connected to the upper part of the tube (T) so that a space of an air gap 21 in which air is captured and remains is formed inside the air tube 20. As described above, the air gap 21 is formed by applying a cushion blasting method, so as to precisely control explosion by reducing blasting pollution, such as blast pressure, scattered stones, vibration and noise, generated during explosion.

In general, the cushion blasting is mainly used for open pit blasting. The cushion blasting is carried out through the steps of well-arranging an explosive charge of a small amount in a completely tamped space, blasting a main blast hole and setting off a cushion blast hole, and in this instance, tamping materials absorbs shock applied from explosion of the bedrock to minimize cracking and tension, so that the bedrock is evenly cut by uniform explosive power of the explosive charge to form a clean cut surface.

However, the general cushion blasting is different from blasting using the explosive tube (T) having the air gap according to the present invention because the cushion blasting must explode the main blast hole before setting off the cushion blast hole.

In general, excavation through blasting is to remove the bedrock of the excavation section using shock pressure and gas pressure generated during explosion of the explosives. Because the shock pressure and the gas pressure are propagated deep inside the bedrock in the form of seismic waves, it causes blasting pollution, such as blast pressure and noise, as well as vibration.

In order to control the blasting pollution, there are blasting design, limitation in charge weight, division of firing methods, use of slower explosives, use of MS detonators, and so on. The explosive tube (T) having the air gap according to the present invention can considerably reduce usage of the explosives so as to enhance blasting efficiency and greatly reduce costs of explosives because the tube (T) is charged only with the explosives of a fixed amount necessary for blasting the bedrock(R), can vary the charging amount and the location of the explosives (E) in the plural tubes (T) inserted into the blast hole (H) so as to precisely control blasting through control and uniform distribution of blasting power according to locations, and can enhance the blasting effect due to extension of the blasting length of the explosives in comparison with the same amount of the explosives and expansion of the projection area at the time of blasting using ANFO explosives, which are slower explosives, so as to restrain generation of blasting pressure, scattered stones, vibration and noise generated during explosion.

Figure 6:
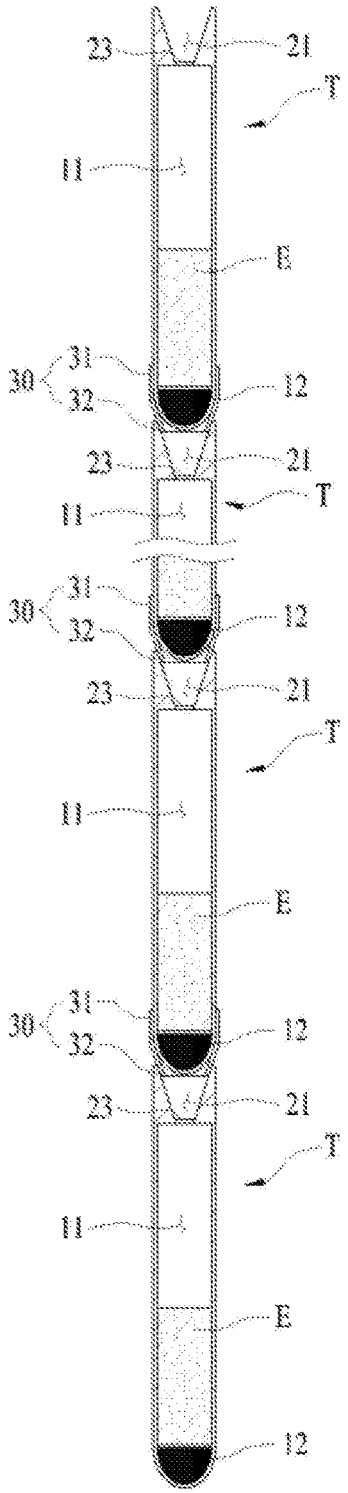

Additionally, as shown in FIG. 6, the explosive tube (T) according to the present invention further includes a connection tube 30 for connecting the tubes with each other.

The connection tube 30 includes an upper connection part 31 and a lower connection part 32, and it is preferable that the diameter of the upper connection part 31 is larger than that of the lower connection part 32.

The tube (T) which is arranged at the upper part is connected to the inside of the upper connection part 31, and the tube (T) which is arranged at the lower part is connected to the outside of the lower connection part 32, and preferably, the tubes (T) are respectively connected to the upper connection part 31 and the lower connection part 32 in a forced fitting manner. However, the connection method is not limited to the above, and the tubes (T) can be respectively connected to the upper connection part 31 and the lower connection part 32 in one of various well-known connection methods, such as a screw coupling method, a tonguing-and-grooving coupling method, and so on.

Therefore, a plurality of the tubes are consecutively connected with one another in the longitudinal direction of the blast hole (H) in correspondence with the depth of the blast hole (H) so as to prevent that the connected tubes are easily separated from one another in the middle of the connected tubes before explosion and to extend the space of the air gap 21.

Hereinafter, referring to the drawings, a method of blasting the bedrock according to the present invention will be described in detail.

The method of blasting the bedrock using the explosive tube having the air gap according to the present invention is a method including the steps of connecting a plurality of tubes, each of which has a charge tube 10 having a charging space charged with explosives and an air tube 20 being integrally formed above the charge tube and having an insertion hole 22 formed in the bottom to put explosives into the tube, with one another, inserting the tubes into a blast hole bored in a bedrock, and blasting the explosives to crush the bedrock.

Figure 8A:
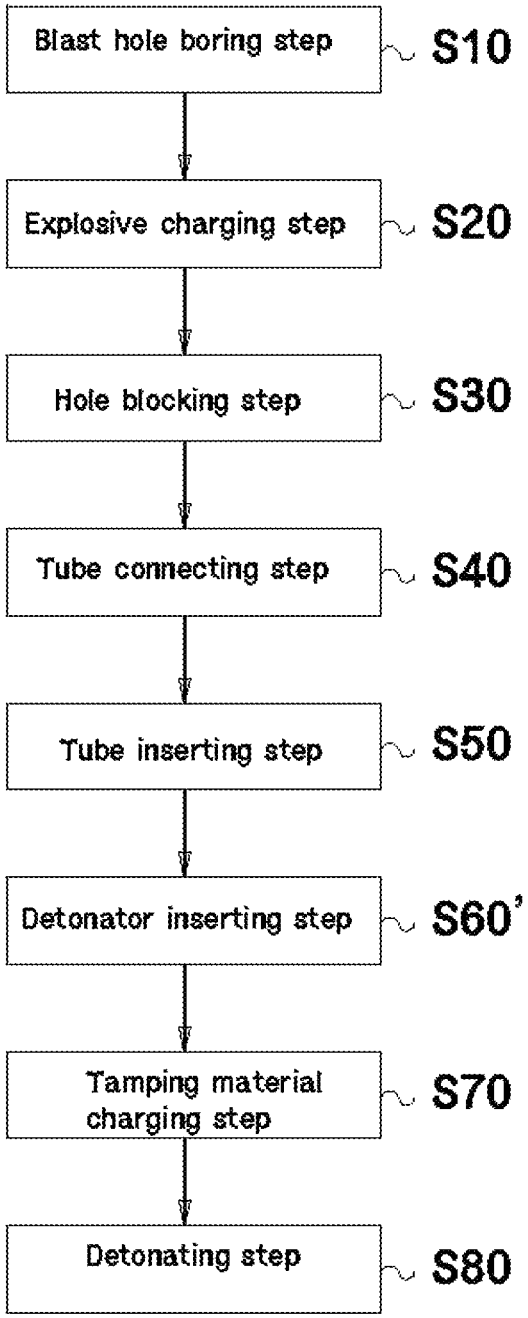
FIGS. 8*a* and 8*b* are flow charts of a rock blasting method according to the present invention.
Figure 8B:
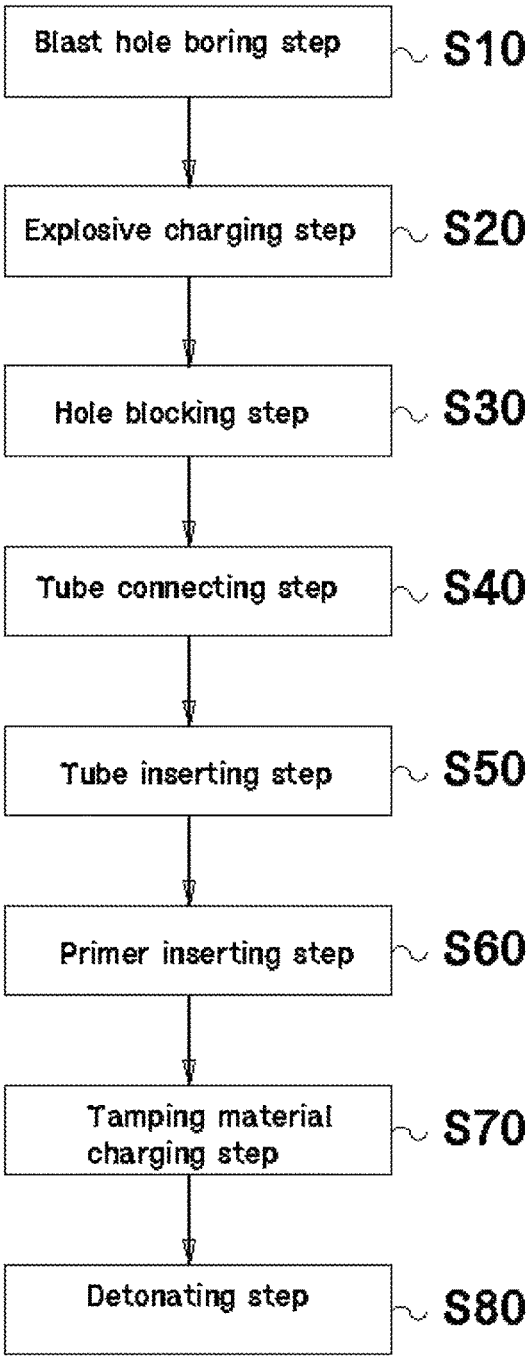

As shown in FIG. 8 illustrating a flow chart, the method of blasting the bedrock according to the present invention includes a blast hole boring step (S10), an explosive charging step (S20), an insertion hole blocking step (S30), a tube connecting step (S40), a tube inserting step (S50), a primer inserting step (S60), a tamping material charging step (S70) and a detonating step (S80).

First, a design for blasting in relation with a bedrock to be crushed is established according to variables, such as geographical features, geological features, ground conditions, blasting methods and surrounding conditions. In this instance, in order to verify the suitability of the blasting design and correct the blasting design, test blasting is carried out in advance, results of the test blasting is analyzed, a prediction equation of blasting vibration is calculated, and then, whether or not the blasting design is suitable for the blasting spot is reviewed.

After that, according to the blasting design, the blast hole boring step (S10) for boring a plurality of blast holes (H) deep into a bedrock (R) in a predetermined arrangement is carried out.

Figure 9:
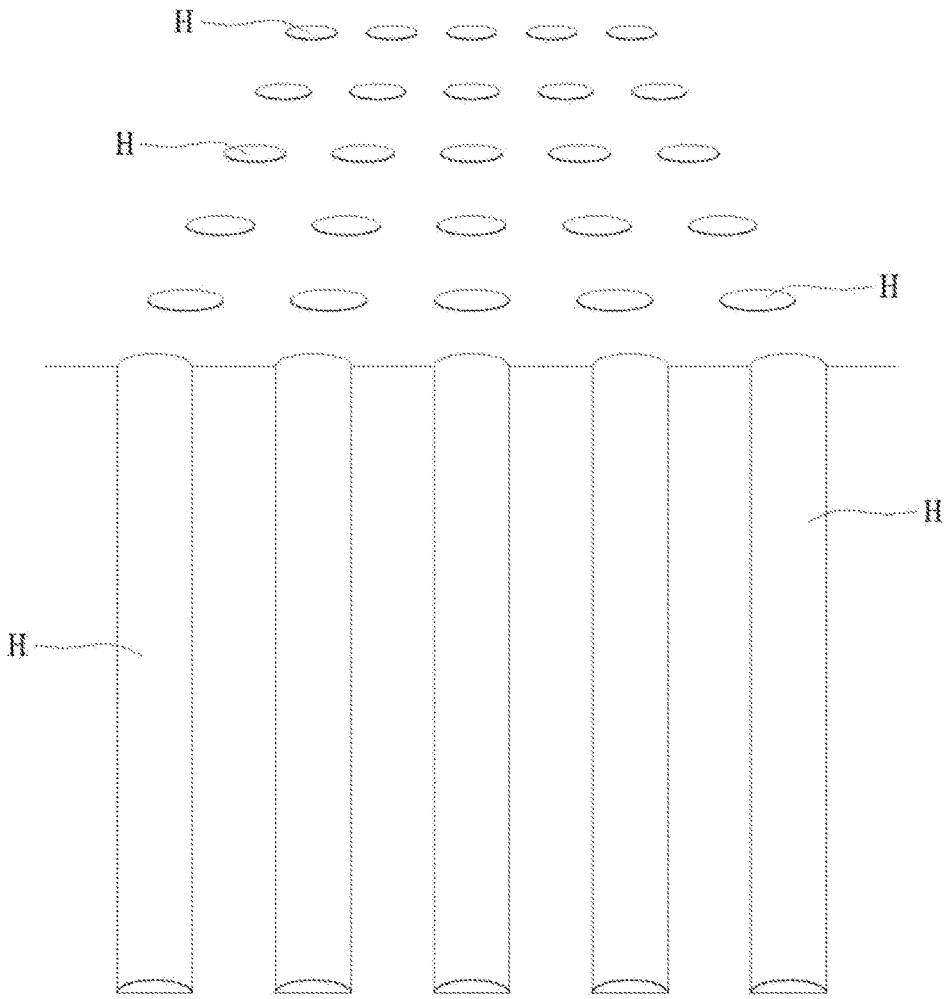
FIG. 9 is a view showing a state where the tubes according to the present invention are used in a plurality of blast holes bored in a rock body.

As shown in FIG. 9, in the blast hole boring step (S10), a plurality of the blast holes (H) having diameters of several centimeters or several meters are bored and arranged to a predetermined depth at predetermined intervals using a rock drill or a drill, and in this instance, vertical drilling, slope drilling and horizontal drilling may be carried out according to the form of a free face.

After the blast hole boring step (S10), the explosive charging step (S20) for charging explosives (E) into a charging space 11 of the tube (T) through the insertion hole 22 is carried out.

In the explosive charging step (S20), like the conventional method, the charging space 11 of the charge tube 10 is charged with the explosive using a tamping bar or an explosive charger.

In this instance, blasting power can be controlled according to locations when charging amounts and charging locations of the explosives are varied.

After the explosive charging step (S20), the insertion hole blocking step (S30) for blocking the insertion hole 22, which is formed in the bottom of an outlet of the air tube 20, with a lid 23 is carried out.

In the insertion hole blocking step (S30), the insertion hole 22 is blocked by the lid 23 made of a sealing material, such as rubber or silicon, in order to increase waterproofing property by blocking inflow of water, such as underground water.

After the insertion hole blocking step (S30), the tube connecting step (S40) for connecting the plural tubes (T), which are charged with the explosives, with one another is carried out.

In this instance, another tube (T) is connected to an opening of the upper part of the tube (T) so as to form a space for the air gap 21 inside the air tube 20.

Moreover, a connection tube 30 may be interposed between the tubes (T), so that a plurality of the tubes are consecutively connected with one another in the longitudinal direction of the blast hole (H) in correspondence with the depth of the blast hole (H) so as to prevent that the connected tubes are easily separated from one another in the middle of the connected tubes.

After the tube connecting step (S40), the tube inserting step (S50) for inserting a plurality of the tubes (T) into the blast hole (H) is carried out.

Figure 10A:
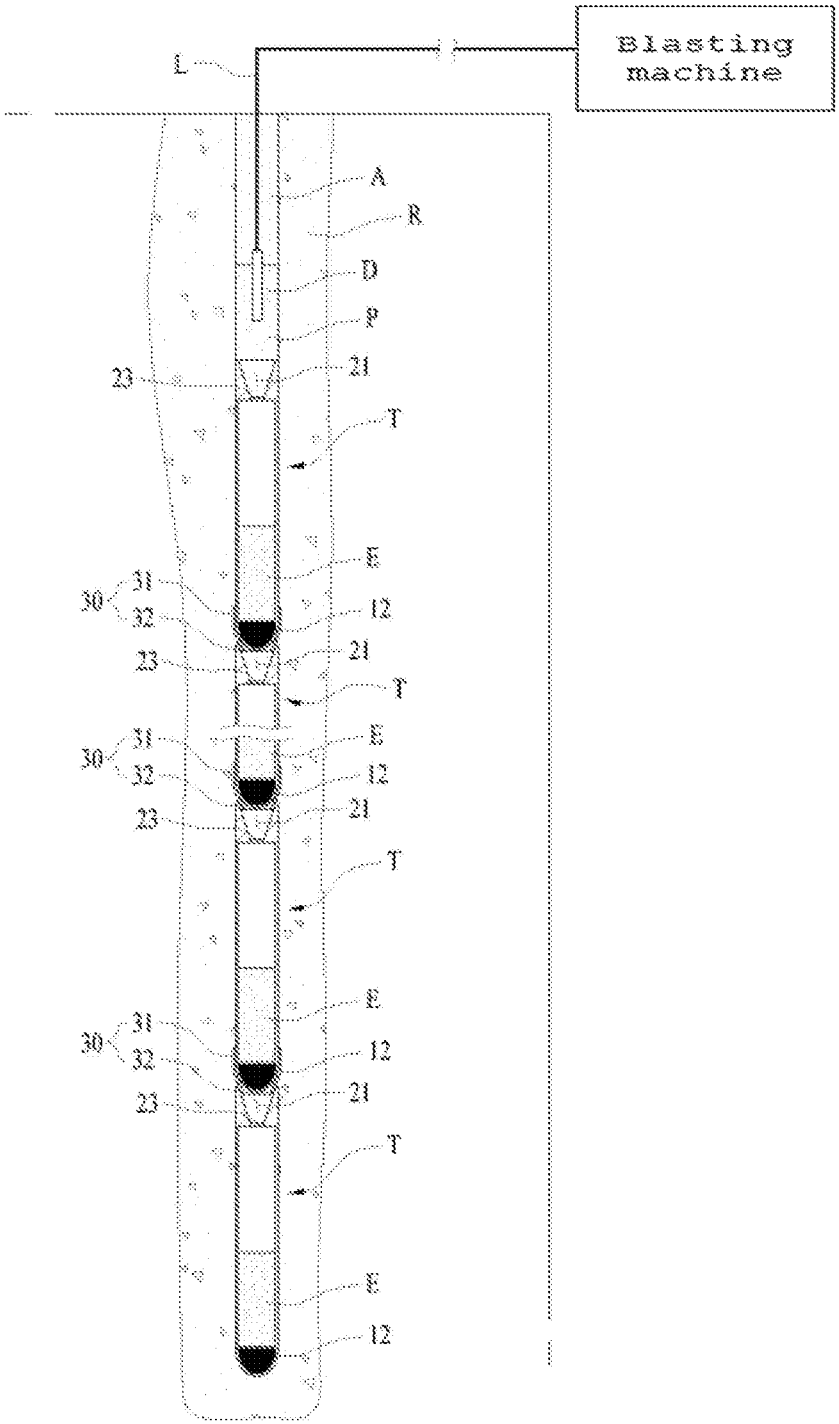
FIG. 10*a* is a view showing a state where a primer and a detonator are mounted outside the tube.
Figure 10B:
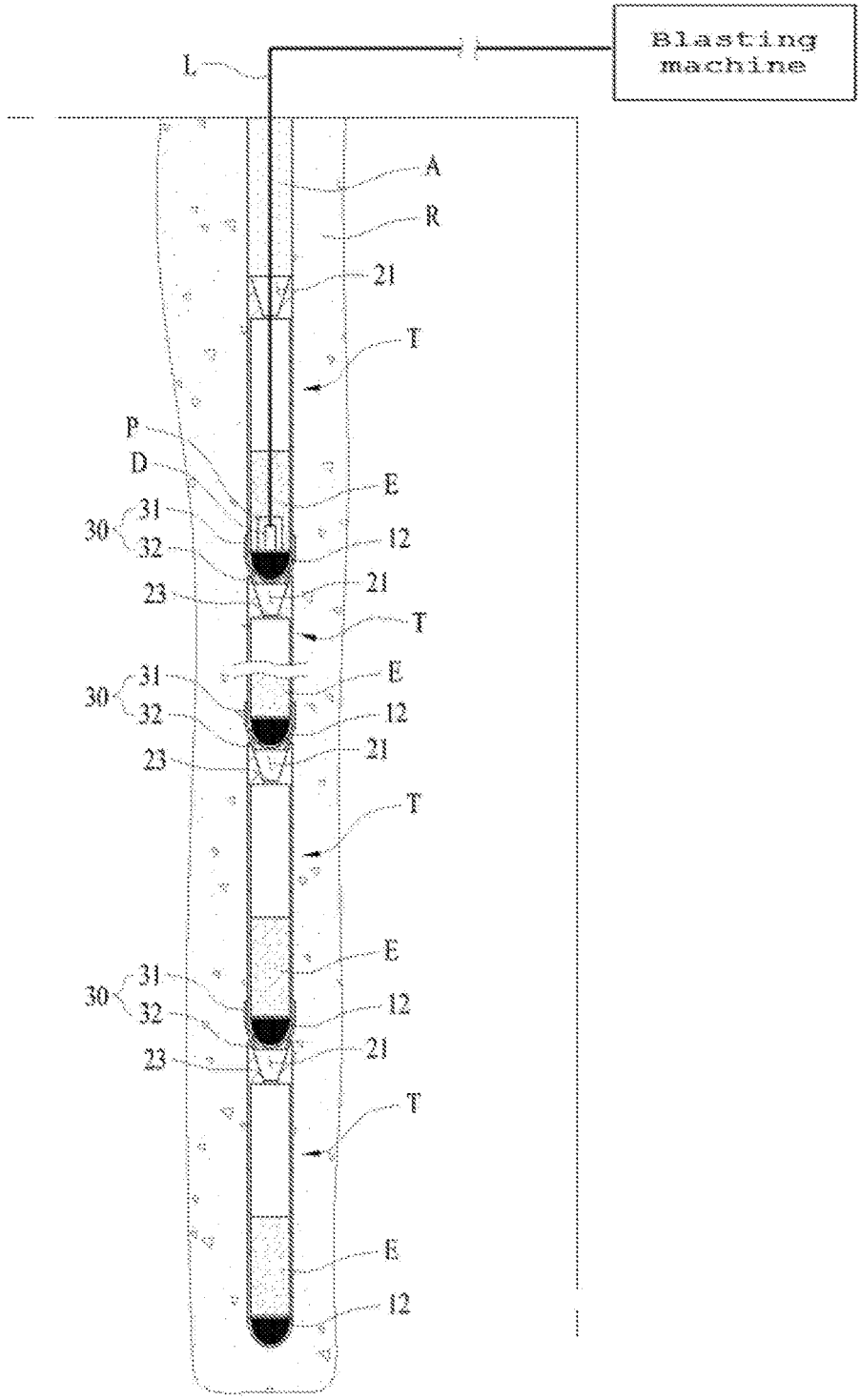
FIG. 10*b* is a view showing a state where a primer and a detonator are mounted inside the tube.

Furthermore, as shown in FIG. 10*a* or 10*b*, the primer inserting step (S60) for inserting a primer (P), to which a detonator (D) is connected, to the inside of the charge tube 10 of the tube (T) inserted into the blast hole (H) or to the upper part of the tube (T) inserted into the uppermost part of the blast hole (H) is carried out.

In general, in case of ANFO explosives, because it is difficult to completely explode the ANFO explosives just by a detonator, after a primer which has large detonation pressure is put between the detonator and a main explosive, the primer is first exploded, and then, the main explosive is surely exploded.

In this instance, preferably, emulsion-based explosives which have been used widely and recently is used as the primer (P).

Furthermore, because a plurality of the tubes (T) are connected and mounted inside the blast hole (H), a position of a detonation point may be selected freely to carry out all of direct priming, middle priming and indirect priming, but preferably, direct priming which has a detonation point at the inlet of the blast hole (H) is used.

Therefore, the present invention has economic effects because shock waves reach the free face rapidly, explosive power is great due to great intensity of a reflecting plate reflected from the free face, insertion of the detonator (D) and arrangement of detonator leads (L) are easy and convenient and the detonator leads (L) get shorter.

Figure 10C:
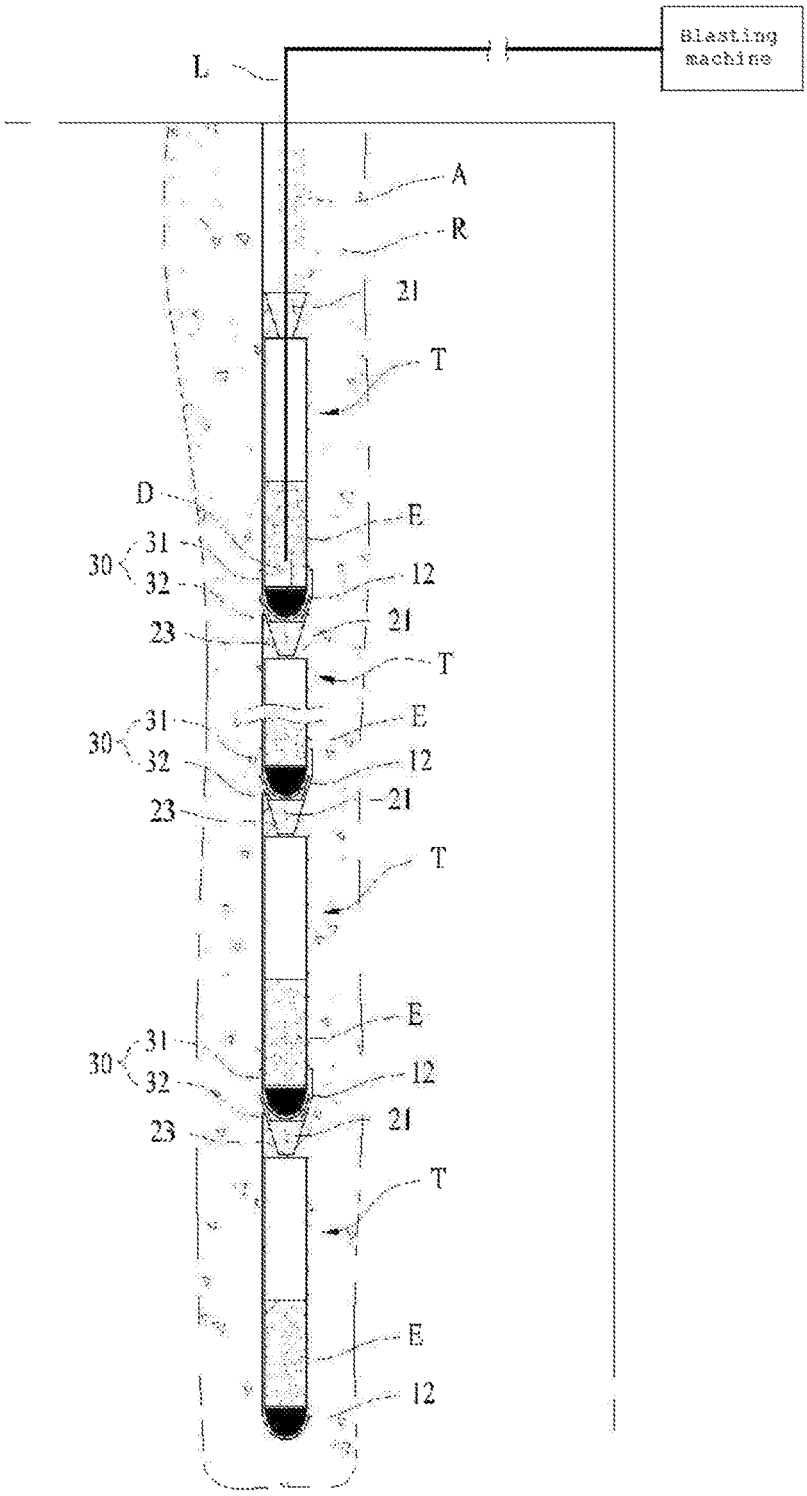
FIG. 10*c* is a view showing a state where a detonator is mounted inside the tube.

On the contrary, as shown in FIG. 10*c*, in the case that it is possible to carry out blasting just by the detonator (D) without using the primer (P), instead of the primer inserting step (S60), a detonator installing step (S60') for inserting and installing the detonator (D) to the inside of the charge tube 10 of the tube (T) inserted into the blast hole (H) may be carried out.

After the primer inserting step (S60) or the detonator installing step (S60'), the tamping material charging step (S70) for charging tamping materials (A) in the remaining space of the blast hole (H) is carried out.

The tamping materials (A) serve to prevent a loss of explosive power and reduce explosive noise by putting nonflammable materials into the remaining space after the explosives are charged, and so, the tamping materials (A) may be sand, mud or debris.

After the tamping material charging step (S70), the detonating step (S80) for detonating the detonator (D) by a blasting machine from the outside to crush the bedrock (R) is carried out. The blasting machine is a tool to detonate the detonator, and is divided into electric blasting machines and nonelectric blasting machines. In case of the ANFO explosives, it is good to use the nonelectric detonator due to the problem of static electricity.

In the meantime, the order to insert or charge the tubes (T), the primers (P) and the explosives (E) into the blast hole (H) may be varied in consideration of kinds of blasting, characteristics of rocks and surrounding environment.

For instance, the tubes (T) are inserted into the blast hole (H) after the primer (P) to which the detonator (D) is connected is arranged at the upper part of the blast hole (H) or the primer (P) to which the detonator (D) is connected is arranged at the lower part of the blast hole (H), or the primer (P) to which the detonator (D) is connected is arranged in the middle of the blast hole (H). That is, the present invention may have various structure to carry out detonation, and the detonator (D) may be directly connected not to the inside of the blast hole (H) but to the inside of the tube (T).

Finally, the explosive tube and the method of blasting a bedrock using the same according to the present invention can quantify explosives and reduce an explosive usage by forming an air gap onto an upper part of a tube so as to increase blasting efficiency and significantly reduce expenses, increase the length of a cartridge of the explosives in comparison with the same amount of the explosives, and enlarge a projection area at the time of explosion so as to increase blasting effect, and reduce blasting pollution, such as blast pressure, scattered stones, vibration and noise, generated during explosion by applying a cushion blasting method. Moreover, the explosive tube and the method of blasting a bedrock using the same according to the present invention can set a charge amount and a charging location of explosives in various ways so as to precisely control explosion, for instance, by controlling power of explosion, prevent back break that rocks are destroyed beyond a design, and carry out concentrated crushing toward a crushing direction of rocks. Furthermore, the explosive tube and the method of blasting a bedrock using the same according to the present invention can be easily applied to varied geographies with lots of underground water or cavities through an increase of waterproofing property by blocking the insertion hole with the lid. Additionally, when blasting is carried out using direct priming after the detonator is located at the inlet of the blast hole, because shock waves reach the free face rapidly, the explosive tube and the method of blasting a bedrock using the same according to the present invention can increase blasting power and make insertion of the detonators and arrangement of the detonator leads easy and convenient.

While the present invention has been particularly shown and described with reference to exemplary embodiments thereof, it will be understood by those of ordinary skill in the art that the present invention is not restricted to the embodiments and various changes in form and details may be made therein without departing from the technical idea and scope of the present invention as defined by the following claims.

According to the present invention, the explosive tube and the method of blasting a bedrock using the same can quantify explosives and reduce an explosive usage by forming an air gap onto an upper part of a tube so as to increase blasting efficiency and significantly reduce expenses, increase the length of a cartridge of the explosives in comparison with the same amount of the explosives, and enlarge a projection area at the time of explosion so as to increase blasting effect, and reduce blasting pollution, such as blast pressure, scattered stones, vibration and noise, generated during explosion by applying a cushion blasting method. Moreover, the explosive tube and the method of blasting a bedrock using the same according to the present invention can set a charge amount and a charging location of explosives in various ways so as to precisely control explosion, for instance, by controlling power of explosion, prevent back break that rocks are destroyed beyond a design, and carry out concentrated crushing toward a crushing direction of rocks. Furthermore, the explosive tube and the method of blasting a bedrock using the same according to the present invention can be easily applied to varied geographies with lots of underground water or cavities through an increase of waterproofing property by blocking the insertion hole with the lid. Additionally, when blasting is carried out using direct priming after the detonator is located at the inlet of the blast hole, because shock waves reach the free face rapidly, the explosive tube and the method of blasting a bedrock using the same according to the present invention can increase blasting power and make insertion of the detonators and arrangement of the detonator leads easy and convenient.

The invention claimed is:

1. An explosive tube which is used to crush a bedrock by blasting explosives after a plurality of the tubes charged with the explosives are connected with one another and are inserted into a blast hole bored in a bedrock, the explosive tube comprising:

a charge tube having a charging space charged with explosives; and an air tube which is formed integrally above the charge tube, has a space of an air gap formed therein when another tube is connected to the upper part of the former tube, and has an insertion hole formed in the bottom to charge the charging space with the explosives, wherein the charge tube has a weight inserted and mounted to the lower part thereof and a scale indicated on the outer circumferential surface thereof.

2. The explosive tube according to claim 1, wherein the tube has an induction groove formed in a longitudinal direction of the tube to induce a blasting direction to the outer circumference.

3. The explosive tube according to claim 1, wherein the charge tube is rounded at a lower end portion thereof.

4. The explosive tube according to claim 1, wherein the inner circumferential surface of the air tube is tapered downward.

5. The explosive tube according to claim 1, wherein the air tube further has a lid for blocking the insertion hole after the charge tube is charged with the explosives.

6. The explosive tube according to claim 1, further comprising:

a connection tube for connecting the tubes with each other.

7. The explosive tube according to claim 1, wherein the charge tube is charged with mixture of an ammonium nitrate fuel oil (ANFO) explosive and an emulsion-based explosive.

* * * * *